United States Patent [19]

Fischer

[11] Patent Number: 4,634,475

[45] Date of Patent: Jan. 6, 1987

[54] DEEP-DRAWABLE ALUMINUM SHEET OR STRIP AND METHOD OF MAKING SAME

[75] Inventor: Fritz Fischer, Freising, Fed. Rep. of Germany

[73] Assignee: Austria Metall Aktiengesellschaft, Vienna, Austria

[21] Appl. No.: 453,176

[22] Filed: Dec. 27, 1982

Related U.S. Application Data

[63] Continuation of Ser. No. 240,244, Mar. 3, 1981, abandoned.

[30] Foreign Application Priority Data

Mar. 6, 1980 [DE] Fed. Rep. of Germany ..... 3008679

[51] Int. Cl.[4] ..... C22F 1/04

[52] U.S. Cl. ..... 148/11.5 A; 148/437

[58] Field of Search ..... 148/11.5 A, 4, 437–440

[56] References Cited

U.S. PATENT DOCUMENTS 3,487,674 1/1970 Fujimoto et al. ..... 72/366

FOREIGN PATENT DOCUMENTS 2549249 6/1976 Fed. Rep. of Germany .

OTHER PUBLICATIONS

DE-Z "Stahl und Eisen" 80 (1960), 22, S. 1524 bis 1531.
DD-Z. "Stal in Deutsch" (1967), 5, S. 499 bis 500.

*Primary Examiner*—R. Dean
*Attorney, Agent, or Firm*—Karl F. Ross; Herbert Dubno

[57] ABSTRACT

Deep-drawable aluminum sheet or strip wherein the surface of a roller is blasted with broken cast steel to profile the roller, the roller is used to roll the sheet or strip to impart a microroughness consisting predominantly of steep-flank slender peaks separated by troughs thereto, and the peaks are then soft-annealed.

7 Claims, 3 Drawing Figures

DEEP-DRAWABLE ALUMINUM SHEET OR STRIP AND METHOD OF MAKING SAME

This application is a continuation of application Ser. No. 240,244, filed Mar. 3, 1981, abandoned.

FIELD OF THE INVENTION

The invention relates to deep-drawable sheet or strip from nonferrous metal or alloys, in particular aluminum, with a surface treated for deep-drawing. The invention also relates to a method for the production of such sheet, or strip.

BACKGROUND OF THE INVENTION

It is known that in the deep-drawing of sheets, particularly relatively thin sheets, the frictional situation between the holding down device and the pull part is important, since this influences the continuity of flow of the workpiece into the die. In order to obtain workpieces free from wrinkles and cracks, in addition to the friction other parameters have to be adapted such as the material, drawing part shape, drawing slot, hold-down pressure and the like. For example, wrinkle formation at the drawing part cannot be prevented by unlimited increase of the hold-down pressure, since increased frictional forces result in crack formation in the drawing part. Also the use of lubricants does not result in the desired success, if the usual smooth or directed surface structures are employed. The film of the lubricant in this case is squeezed away from the hold-down device such that the friction at this place of highest load rapidly reaches an impermissible level and results in a tearing of the drawing part. It is also known that an improvement of the frictional situation at the drawing slot and at the hold-down device results if in place of the usual rolled-bright, matte, brushed, ground or with foil-covered flat surface a roughened surface is employed, which allows at the contact surface the production of a high lubricant pressure. Thus it is known to employ work rollers with corrugated valleys, which are generated by grinding, to produce a roughened surface (Austrian patent disclosure No. AT-PS 325,236), or trough shaped impressions which are generated by sand blasting (Austrian patent disclosure No. AT-PS 347,387), for aluminum and aluminum alloys for rolling, since the impressions keep the lubricant in place during the rolling. A sheet produced in this way does not show advantageous properties in the subsequent deep-drawing process, since the valleys are pulled by the rolling operation in longitudinal direction with a large longitudinal elongation and are thereby directed, so that the lubricant can escape in this direction during the drawing process.

OBJECTS OF THE INVENTION

It is an object of the invention to provide sheet or strip suitable for deep-drawing and having an improved surface.

Another object is to provide a method of making such sheet or strip and a deep-drawing method utilizing same.

SUMMARY OF THE INVENTION

For achieving these objects sheet, strip or the like is provided with a surface having micro-roughness from about 0.8 to 5 micrometers, (microns) with predominantly slender peaks finely distributed over the surface.

It has been found that a deep-drawing workpiece with such a micro-surface provides upon deep-drawing very advantageous frictional situations between the hold-down device and the workpiece, which allow continuous flow of the workpiece material into the die and thus the formation of cracks and wrinkles is substantially avoided. Such a micro-surface results, upon application of a lubricant, in particularly advantageous frictional situations, since the peaked profiles in conjunction with the applied hold-down device retain the lubricant and prevent it from being pressed away.

It is particularly advantageous if the micro-impressions are flattened or rounded off in the areas of their bottoms to avoid a notch-fracture effect.

It has in addition been found to be very advantageous that the micro-profile of the sheet having as low a a hardness as possible.

In accordance with the invention, the micro-surface of the sheet or strip can be most easily and best achieved by after rolling, if the roller is correspondingly roughened by sand-blasting.

It is appropriate if the rolling is performed with at least one roughened roller in a last rolling step with a thickness decrease of the workpiece of at most 6 percent and preferably of 3 percent.

The rolling is performed to yield a soft recrystallized microstructure in the area of the micro-protrusions before the solution and soft annealing.

SPECIFIC DESCRIPTION

Figure 1:
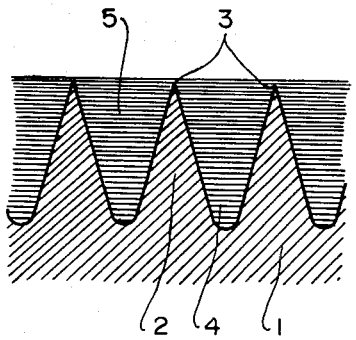
FIG. 1 is a sheet cross-section with a peaked surface profile according to the invention.

In the sheet metal section 1 shown micro-profiles 2 protrude from the surface and are substantially uniformly distributed. They have the shape of slender cones with peaks 3. The valleys 4 between the profiles are advantageously flattened or rounded off in order to avoid the effects of notches. The micro-surface is covered with a lubricant 5. As can be recognized from FIG. 2, the peaks of the profiles 2 are flattened with a holding down device 7 at 8, whereby the valleys 4 are sealed such that the lubricant filling received remains closed in.

In order to obtain the desired micro-surface, the invention utilizes an after-rolling with rollers having sand-blasted roller surfaces such that a substantially uniform surface is generated, which results by way of a minor flattening of the sand-blasted profiles on the roller in no sharp notches in the profile base of the sheet rolled therewith. The optimal roughness Ra was formed to be 1.5 to 3.3 microns. In order to avoid an aligning or orientation, respectively, of the surface structure by the forming it is in addition advantageous to choose the thickness-reduction of the roller pass so as not substantially to exceed 3 percent. Especially for complicated drawn parts, where the limit of deformation is approached, the roller pass is to be performed before a solution or soft annealing depending on the alloy employed. By the successive annealing steps the profiles hardened by the after-rolling are softened again, which facilitates flattening of the peaks with the holding down device. The glow annealing thus meets the requirement of a possibly soft characteristic of the micro-profile. The annealing should be provided such that its effect is if possible directed only to influencing the micro-profiles and that the mechanical and technological values of the base material remain free from undesired effects.

The rollers employed for the after rolling of the sheets are advantageously sandblasted in a chamber. The hardness of the rollers should be at least 95 Shore-C. For this purpose a blast with steel cast broken pieces with a hardness HRC of from 62 to 65 and the grain sizes Nr. 2 to Nr. 4 at a maximum grain size of from 0.5 to 1.5 mm (with fine material removed) can be employed. The centrifugal velocities can be from 50 to 150 m/s. The blasting is performed with a rotating roller and with axial displacement of the blast beam.

The soft annealing is preferably carried out in a continuously operating strip pul-through furnace with or without protective gas. The pass-through time through the furnace should be from 30 to 90 seconds and preferably from 50 to 60 seconds and the final temperature of the strip should amount to from 400° to 500° C. and preferably from 490° to 520° C.

The tests for the determination of the improvement of the deep drawing capability by generation of a micro-surface were performed with the aluminum alloys AlMg4 and AlMg Si for large surface, complicated deep-drawn parts for the vehicle industry with flat sheet sizes of 900×1.550 mm. For comparison flat sheets from the same materials, in each case even from the same hot strip were employed, however the surfaces were roller-bright and dull as well as dull-rolled and covered with deep-drawing foil. The sheet thickness was 1.0 mm. All flat bars including those covered with plastic foil were greased. In the deep-drawing tests with the micro-surfaces provided in accordance with the invention a 10 to 15 percent lower compression pressure was required for the production of the deep-drawn part and even this had an effect on the friction situation. The selected complicated deep-drawn bodies resulted in 30 to 100 percent scrap from crack formation with the comparative tests, while from 40 deep-drawn parts with the selected micro-surfaces generated by rolling and a roughness Ra=1.8 micrometers no scrap was produced. In addition the wrinkle formation, for the avoidance of which in the comparison sheets a relatively high hold-down pressure was required, was clearly less in sheets with the micro-surface of the invention such that for an additional increase of the safety against tearing the hold-down pressure could even be reduced to some extent.

Figure 2:
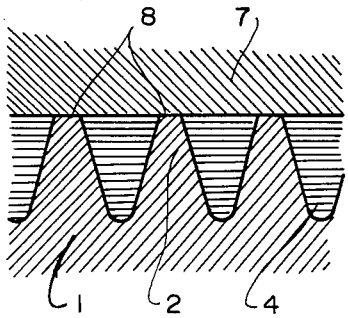
FIG. 2 is a section through the same sheet, with the hold-down device in place.

The invention is not limited to the embodiment shown in FIGS. 1 and 2. For example not all micro-protrusions have a uniform cone shape. The protrusions can also deviate from each other in their height and the cross-sectional faces parallel to the height or base and can in fact be of a variety of shapes. It is important however, that the micro-profiles are not in an aligned position but in a position staggered with respect to each other in a distribution as fine as possible on the surface of the sheet. This achieves a sufficient and uniform continuous flow of the workpiece material into the die or forging die and in case of applying a lubricant the pressing away of the same is substantially prevented.

Figure 3:
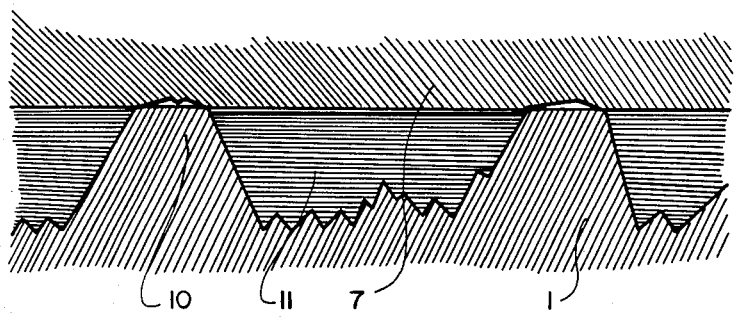
FIG. 3 is a sheet cross-section with a less advantageous micro-surface.

In a micro-profile according to FIG. 3 of the drawing with very irregularly distributed, block-like protrusions 10 and with larger intervals 11, a so-called table mountain surface, the previously mentioned advantages cannot be achieved.

The invention includes all possible methods such as chemical, mechanical, thermal and the like methods which are suitable to provide the micro-surface disclosed.

I claim:

1. A method of making a deep-drawable aluminum sheet or strip which comprises the steps of:

(a) blasting the surface of a roller with broken cast steel of a Rockwell hardness on the C scale of 62 to 65 and a grain size in the range of Nos. 2 to 4 with a centrifugal velocity of 50 to 150 m/s to profile said roller; and (b) rolling an aluminum workpiece in a plurality of rolling steps and applying a micro roughness to one surface of said workpiece of 0.8 to 5 microns in the last rolling step with said roller, said micro roughness consisting predominantly of steep-flank slender peaks finely distributed over said surface of said workpiece and separated by troughs rounded off where the flanks of the peaks meet the troughs; and soft-annealing said peaks to soften at least the tips thereof.

2. The method defined in claim 1 wherein the last rolling step is performed with a decrease in thickness of about 3% of the workpiece.

3. The method defined in claim 1 wherein the workpiece is soft-annealed by displacing it through an annealing furnace with a residence time of 30 to 90 seconds so as to raise the temperature of said workpiece upon emergence from said annealing furnace to 400° to 550° C.

4. A deep-drawable flat aluminum workpiece having a lubricant-retaining surface with a micro roughness of 0.8 to 5 microns in the form of substantially steep-flank slender peaks distributed uniformly over said surface and separated by troughs rounded off where they meet the flanks of said peaks, the peaks having soft tips.

5. The workpiece defined in claim 4 wherein the micro roughness is substantially 1.5 to 2 microns.

6. An aluminum article as made by the method of claim 1.

7. A method of deep-drawing an aluminum workpiece in the form of aluminum sheet or aluminum strip, said method comprising the steps of:

(a) blasting the surface of a roller with broken cast steel of a Rockwell hardness on the C scale of 62 to 65 and a grain size in the range of Nos. 2 to 4 with a centrifugal velocity of 50 to 150 m/s to profile said roller;

(b) rolling an aluminum workpiece in a plurality of rolling steps and applying a micro roughness to one surface of said workpiece of 0.8 to 5 microns in the last rolling step with said roller, said micro roughness consisting predominantly of slender peaks finely distributed over said surface of said workpiece, said last rolling step decreasing the thickness of said workpiece by at most 6%;

(c) soft-annealing the micro roughness to soften at least the tips of said peaks;

(d) applying a lubricant to the surface formed with said micro roughness whereby said lubricant fills spaces between said peaks; and (e) drawing said workpiece while applying a hold-down element thereto with a force such that said hold-down element flattens at least some of said peaks and traps said lubricant within spaces between said peaks.

* * * * *